US010672323B2

(12) United States Patent
Lin et al.

(10) Patent No.: US 10,672,323 B2
(45) Date of Patent: Jun. 2, 2020

(54) DISPLAY DEVICE HAVING A PLURALITY OF SUBPIXELS HAVING SHARED DATA LINE AND GATE LINE

(71) Applicant: E Ink Holdings Inc., Hsinchu (TW)

(72) Inventors: Chien-Hung Lin, Hsinchu (TW); Shu-Fen Tsai, Hsinchu (TW); Yi-Lung Wen, Hsinchu (TW); Ian French, Hsinchu (TW); Ji-Yuan Li, Hsinchu (TW); San-Long Lin, Hsinchu (TW); Kuang-Heng Liang, Hsinchu (TW); Jia-Hung Chen, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 16/150,295

(22) Filed: Oct. 3, 2018

(65) Prior Publication Data

US 2019/0122603 A1 Apr. 25, 2019

(30) Foreign Application Priority Data

Oct. 25, 2017 (TW) ..... 106136763 A

(51) Int. Cl.

*G09G 3/22* (2006.01)
*G09G 3/20* (2006.01)
*G09G 3/34* (2006.01)

(52) U.S. Cl.

CPC ..... *G09G 3/22* (2013.01); *G09G 3/2085* (2013.01); *G09G 3/344* (2013.01); *G09G 2320/0295* (2013.01); *G09G 2320/041* (2013.01)

(58) Field of Classification Search

CPC ..... G09G 3/22
USPC ..... 345/55
See application file for complete search history.

(56) References Cited

U.S. PATENT DOCUMENTS

| | | | |
|---|---|---|---|
| 5,760,855 | A | 6/1998 | Nakase et al. |
| 6,317,174 | B1 | 11/2001 | Noumi et al. |
| 6,353,464 | B1 | 3/2002 | Noumi et al. |
| 6,646,693 | B2 | 11/2003 | Zhang et al. |
| 7,053,890 | B2 | 5/2006 | Inukai |
| 7,139,044 | B2 | 11/2006 | Lee et al. |

(Continued)

FOREIGN PATENT DOCUMENTS

| | | |
|---|---|---|
| CN | 1496204 A | 5/2004 |
| CN | 1727971 A | 2/2006 |

(Continued)

OTHER PUBLICATIONS

Corresponding Taiwan office action dated Jul. 20, 2018.
Corresponding Chinese office action dated Apr. 3, 2020.

*Primary Examiner* — Long D Pham
(74) *Attorney, Agent, or Firm* — CKC & Partners Co., LLC

(57) ABSTRACT

A display device includes a selection line, a data line and plural pixel units. Each of the pixel units includes a first subpixel and a second subpixel. The second subpixel is disposed around the first subpixel and surrounds the first subpixel. The first subpixel includes a first capacitor, and the second subpixel includes a second capacitor. The selection line is configured to provide a selection signal. The data line is configured to provide a data signal. The first subpixel is configured to transmit the data signal to the first capacitor according to the selection signal, and the second subpixel is configured to transmit the data signal to the second capacitor according to the selection signal.

10 Claims, 6 Drawing Sheets

(56) References Cited

U.S. PATENT DOCUMENTS

| | | | | |
|---|---|---|---|---|
| 7,710,506 | B2 | 5/2010 | Lee et al. | |
| 7,940,346 | B2 | 5/2011 | You et al. | |
| 7,986,379 | B2 | 7/2011 | Lee et al. | |
| 8,520,160 | B2 | 8/2013 | You et al. | |
| 2005/0083353 | A1 | 4/2005 | Maruyama et al. | |
| 2006/0227081 | A1* | 10/2006 | Joo | G09G 3/3233 345/76 |
| 2008/0158143 | A1 | 7/2008 | Kim et al. | |
| 2009/0009449 | A1* | 1/2009 | Uchida | G02F 1/13624 345/87 |
| 2011/0181502 | A1 | 7/2011 | Kim et al. | |
| 2011/0221715 | A1* | 9/2011 | Yang | G02F 1/13454 345/204 |
| 2015/0069530 | A1 | 3/2015 | Huang et al. | |

FOREIGN PATENT DOCUMENTS

| | | | |
|---|---|---|---|
| CN | 103226274 | A | 7/2013 |
| CN | 106098727 | A | 11/2016 |
| CN | 106773429 | A | 5/2017 |
| TW | 200630924 | A | 9/2006 |
| TW | 200715522 | A | 4/2007 |
| TW | 200739498 | A | 10/2007 |

* cited by examiner

DISPLAY DEVICE HAVING A PLURALITY OF SUBPIXELS HAVING SHARED DATA LINE AND GATE LINE

RELATED APPLICATION

This application claims priority to Taiwan Application Serial Number 106136763, filed Oct. 25, 2017, which is herein incorporated by reference.

BACKGROUND

The present disclosure relates to a display technique. More particularly, the present disclosure relates to a display device.

A conventional electronic paper display (EPD) often has poor display quality due to pixel electrical leakage under a high temperature environment. In addition, when neighboring pixels have different polarities, pixel electric leakage is likely to occur, thus resulting in poor display quality.

SUMMARY

An aspect of the present disclosure is to provide a display device that includes a selection line, a data line and plural pixel units. Each of the pixel unit includes a first subpixel and a second subpixel. The second subpixel is disposed around the first subpixel and surrounds the first subpixel. The first subpixel includes a first capacitor, and the second subpixel includes a second capacitor. The selection line is configured to provide a selection signal. The data line is configured to provide a data signal. The first subpixel is configured to transmit the data signal to the first capacitor according to the selection signal, and the second subpixel is configured to transmit the data signal to the second capacitor according to the selection signal.

In one embodiment, the first subpixel further includes a first transistor, and the second subpixel further includes a second transistor. The first transistor is coupled to the selection line and the data line, and the second transistor is coupled to the selection line and the data line. The first transistor is configured to transmit the data signal to the first capacitor according to the selection signal. The second transistor is configured to transmit the data signal to the second capacitor according to the selection signal.

In one embodiment, the first transistor and the second transistor are arranged on two sides of the data line respectively.

In one embodiment, the first subpixel further includes a third transistor, and the second subpixel further includes a fourth transistor. The third transistor is coupled to the selection line, the first transistor and the first capacitor, the fourth transistor is coupled to the selection line, and the second transistor and the second capacitor. The third transistor is configured to receive the data signal transmitted from the first transistor according to the selection signal and to transmit the data signal to the first capacitor. The fourth transistor is configured to receive the data signal transmitted from the second transistor according to the selection signal and to transmit the data signal to the second capacitor.

In one embodiment, the third transistor and the fourth transistor are arranged on two sides of the data line respectively.

In one embodiment, the first transistor and the second transistor are simultaneously turned on or off according to the selection signal.

In one embodiment, the first subpixel further includes a first transistor, and the second subpixel further includes a second transistor. The first transistor is coupled to the selection line and the first capacitor, and the second transistor is coupled to the selection line, the data line, the second capacitor and the first transistor. The first transistor is configured to transmit the data signal to the first capacitor according to the selection signal. The second transistor is configured to transmit the data signal to the second capacitor according to the selection signal, and to transmit the data signal to the first transistor according to the selection signal and to transmit the data signal to the first capacitor.

In one embodiment, the first transistor and the second transistor are simultaneously turned on or off according to the selection signal.

In one embodiment, the display device further includes a data source line, and the data source line is coupled to the data line and is configured to provide the data signal to the data line.

In one embodiment, the selection line and the data source line are arranged along a first direction, and the data line are arranged along a second direction that is different from the first direction.

In summary, the second subpixel surrounded by the first subpixel may improve the electrical leakage of the first capacitor of the first subpixel when being under a high temperature environment or when that neighboring pixels have different polarities, thus improving the display quality of the display device. In addition, the leakage current of the first capacitor and the second capacitor can be reduced by increasing the number of transistors in the first subpixel and the second subpixel, thus further improving—the display quality of the display device.

It is to be understood that both the foregoing general description and the following detailed description are by examples, and are intended to provide further explanation of the disclosed as claimed.

BRIEF DESCRIPTION OF THE DRAWINGS

This disclosure can be more fully understood by reading the following detailed description of the embodiment, with reference made to the accompanying drawings as follows.

DETAILED DESCRIPTION

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in parts of embodiments of the present invention. Furthermore, for simplifying the drawings, some of the conventional structures and elements are shown with schematic illustrations.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

In addition, as used herein, the terms "coupled," "connected" may refer to two or more elements are in direct physical or electrical contact as, or as an entity or indirect mutual electrical contact, and can also refer to two or more elements or acts interoperability.

Figure 1A:
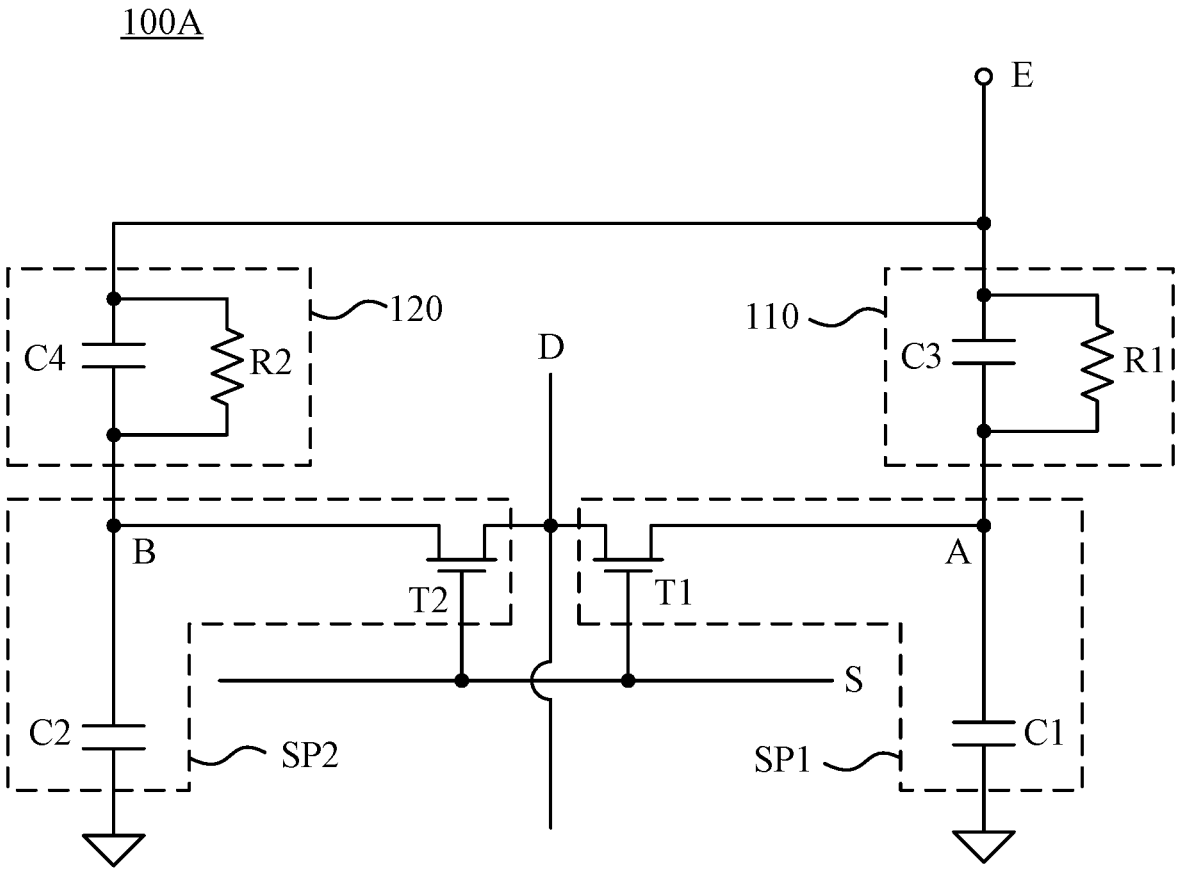
FIG. 1A is a schematic diagram of a display device in accordance with some embodiments of the present disclosure.
Figure 5:
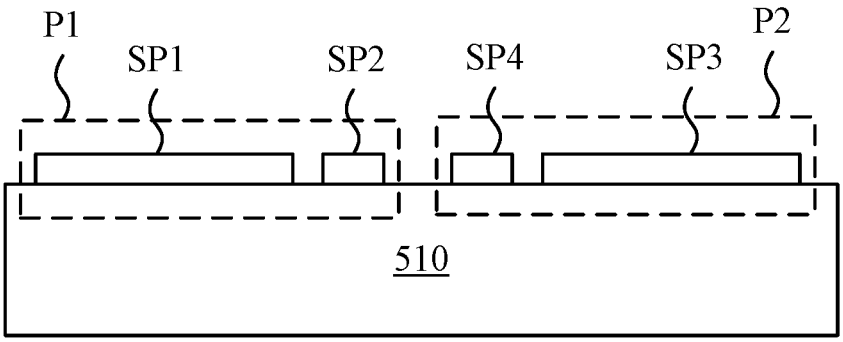
FIG. 5 is a schematic diagram of pixel units and subpixel in accordance with some embodiments of the present disclosure.

Reference is now made to FIG. 1A and FIG. 5. FIG. 1A is a schematic diagram of a display device 100A in accordance with some embodiments of the present disclosure. FIG. 5 is a schematic diagram of pixel units P1 and P2 and subpixels SP1-SP4 in accordance with some embodiments of the present disclosure. The display device 100A includes a selection line S, a data line D and the pixel units P1 and P2. The pixel unit P1 includes the subpixel SP1 and the subpixel SP2, and the pixel unit P2 includes the subpixel SP3 and the subpixel SP4. The selection line S is used to provide a selection signal, and the data line D is used to provide a data signal. The subpixel SP2 is arranged around the subpixel SP1 and surrounds the subpixel SP1. The subpixel SP1 includes a capacitor C1, and the subpixel SP1 is used to transmit the data signal to the capacitor C1 according to the selection signal. Similarly, the subpixel SP2 includes a capacitor C2, and the subpixel SP2 is used to transmit the data signal to the capacitor C2 according to the selection signal. For illustration, the display device 100A may include a number of pixel units, and each of the pixel units includes the subpixel SP1 and the subpixel SP2 described above.

In one embodiment, the subpixel SP1 and the subpixel SP2 are both coupled to the same selection line S, and transmit the same data signal to the capacitor C1 and the capacitor C2 respectively according to the same selection signal provided by the selection line S. In other words, the same selection signal and the same data signal are used to drive the subpixel SP1 and the subpixel SP2.

In one embodiment, the subpixel SP1 further includes a transistor T1, the subpixel SP2 further includes a transistor T2, and the data line D is arranged between the transistor T1 and the transistor T2. In other words, the transistor T1 and the transistor T2 are arranged on two sides of the data line D respectively. As shown in FIG. 1A, a control end of the transistor T1 is coupled to the selection line S, a first end of the transistor T1 is coupled to the data line D, and a second end of the transistor T1 is coupled to the capacitor C1. The transistor T1 is used to transmit the data signal to the capacitor C1 according to the selection signal. Similarly, a control end of the transistor T2 is coupled to the selection line S, a first end of the transistor T2 is coupled to the data line D, and a second end of the transistor T2 is coupled to the capacitor C2. The transistor T2 is used to transmit the data signal to the capacitor C2 according to the selection signal.

In operation, the transistor T1 and the transistor T2 are coupled to the same selection line S, and are simultaneously turned on or off according to the same selection signal. When the transistor T1 and the transistor T2 are simultaneously turned on, the transistor T1 transmits the data signal to the capacitor C1 and the transistor T2 transmits the data signal to the capacitor C2.

As a result, when being under a high temperature environment or under the condition that neighboring pixels have different polarities, the subpixel SP2 surrounding the subpixel SP1 may improve the electric leakage of the capacitor C1 of the subpixel SP1, thus improving the display quality of the display device 100A.

For example, as shown in FIG. 5, the pixel unit P1 and the pixel unit P2 are arranged on a substrate 510, and the pixel unit P1 is close to the pixel unit P2. The pixel unit P1 includes the subpixel SP1 and the subpixel SP2, and the pixel unit P2 includes the subpixel SP3 and the subpixel SP4. As described above, the subpixel SP2 surrounds the subpixel SP1. The subpixel SP2 may improve the electric leakage problem of the subpixel SP1 effectively when being under a high temperature environment or under the condition that the pixel unit P1 and the pixel unit P2 have different polarities. Similarly, the subpixel SP4 surrounds the subpixel SP3, and the subpixel SP4 of the pixel unit P2 also may improve the electric leakage problem of the subpixel SP3. Therefore, the display quality of the display device 100A can be improved effectively.

In one embodiment, as shown in FIG. 1A, the display device 100A includes a front plane laminate (FPL) 110 and a FPL 120. The second end of the transistor T1 is coupled to an equivalent resistor R1 and an equivalent capacitor C3 of the FPL 110, and the second end of the transistor T2 is coupled to an equivalent resistor R2 and an equivalent capacitor C4 of the FPL 120. The FPL 110 and the FPL 120 are coupled to an electrode of the FPL via a node E.

Figure 1B:
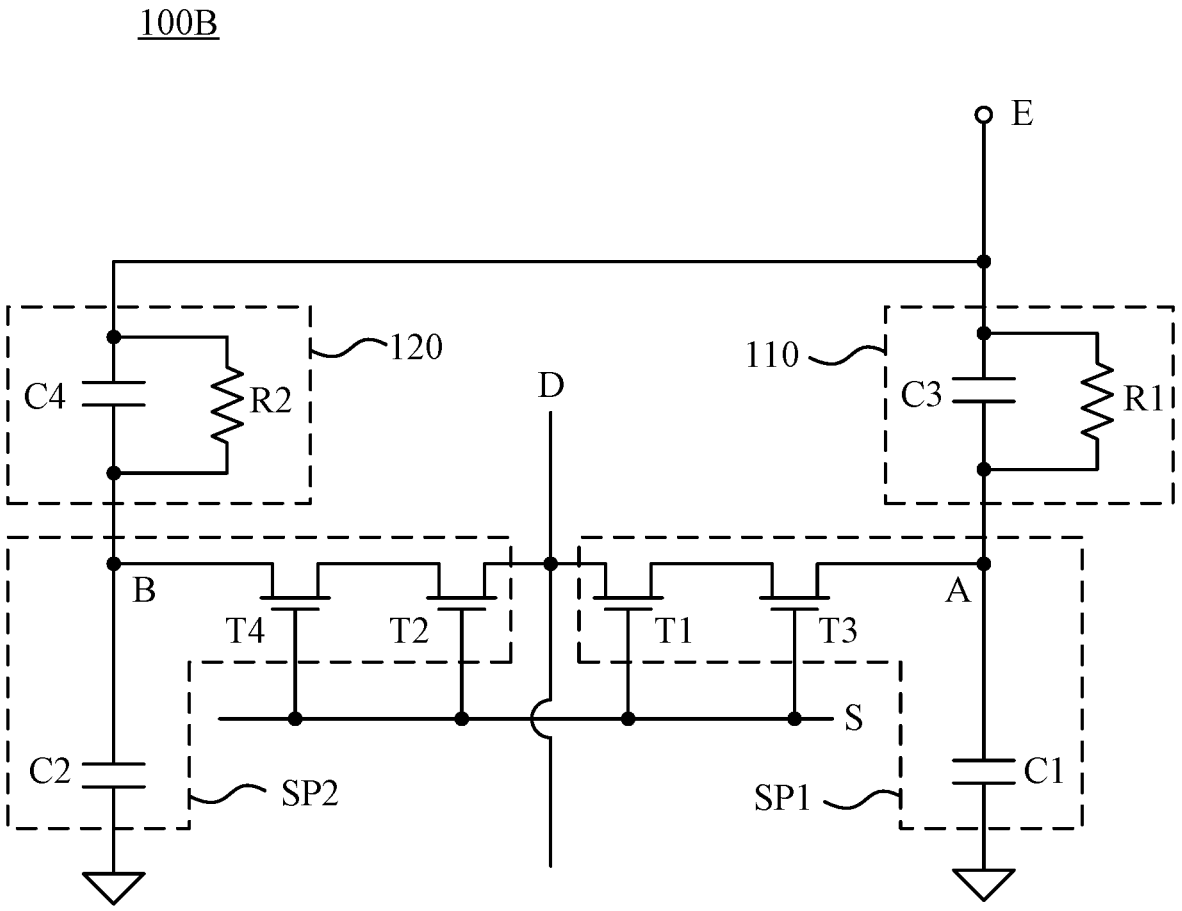
FIG. 1B is a schematic diagram of the display device in accordance with some embodiments of the present disclosure.

In another embodiment, the number of transistors can be increased. Reference is now made to FIG. 1B. FIG. 1B is a schematic diagram of the display device 100B in accordance with some embodiments of the present disclosure. The structure of the display device 100B and the structure of the display device 100A are almost the same besides transistors T3 and T4. The differences between the display device 100B and the display device 100A are described below, in the display device 100B, the subpixel SP1 further includes the transistor T3 and the subpixel SP2 further includes the transistor T4. The transistor T3 is coupled between the transistor T1 and the capacitor C1, and the transistor T4 is coupled between the transistor T2 and the capacitor C2. As shown in FIG. 1B, the transistor T1 and the transistor T3 are arranged on one side of the data line D, and the transistor T2 and the transistor T4 are arranged on the other side of the data line D.

Specifically, a control end of the transistor T3 is coupled to the selection line S, a first end of the transistor T3 is coupled to the second end of the transistor T1, and a second end of the transistor T3 is coupled to the capacitor C1.

Similarly, a control end of the transistor T4 is coupled to the selection line S, a first end of the transistor T4 is coupled to the second end of the transistor T2, and a second end of the transistor T4 is coupled to the capacitor C2.

In operation, the transistors T1-T4 are coupled to the same selection line S, and are simultaneously turned on or off according to the same selection signal. When the transistors T1-T4 are simultaneously turned on or off according to the selection signal, the transistor T1 transmits the data signal to the transistor T3. The transistor T3 then receives the data signal transmitted from the transistor T1, and transmits the data signal to the capacitor C1. At the same time, the transistor T2 transmits the data signal to the transistor T4. The transistor T4 then receives the data signal transmitted from the transistor T2, and transmits the data signal to the capacitor C2.

As a result, the transistor T1 and the transistor T3 which are coupled to the capacitor C1 may further decrease the leakage current of the capacitor C1, and the transistor T2 and the transistor T4 which are coupled to the capacitor C2 may further decrease the leakage current of the capacitor C2. Therefore, the electric leakage problem of the capacitor C1 of the subpixel SP1 can be improved effectively to improve the display quality of the display device 100B.

Figure 2:
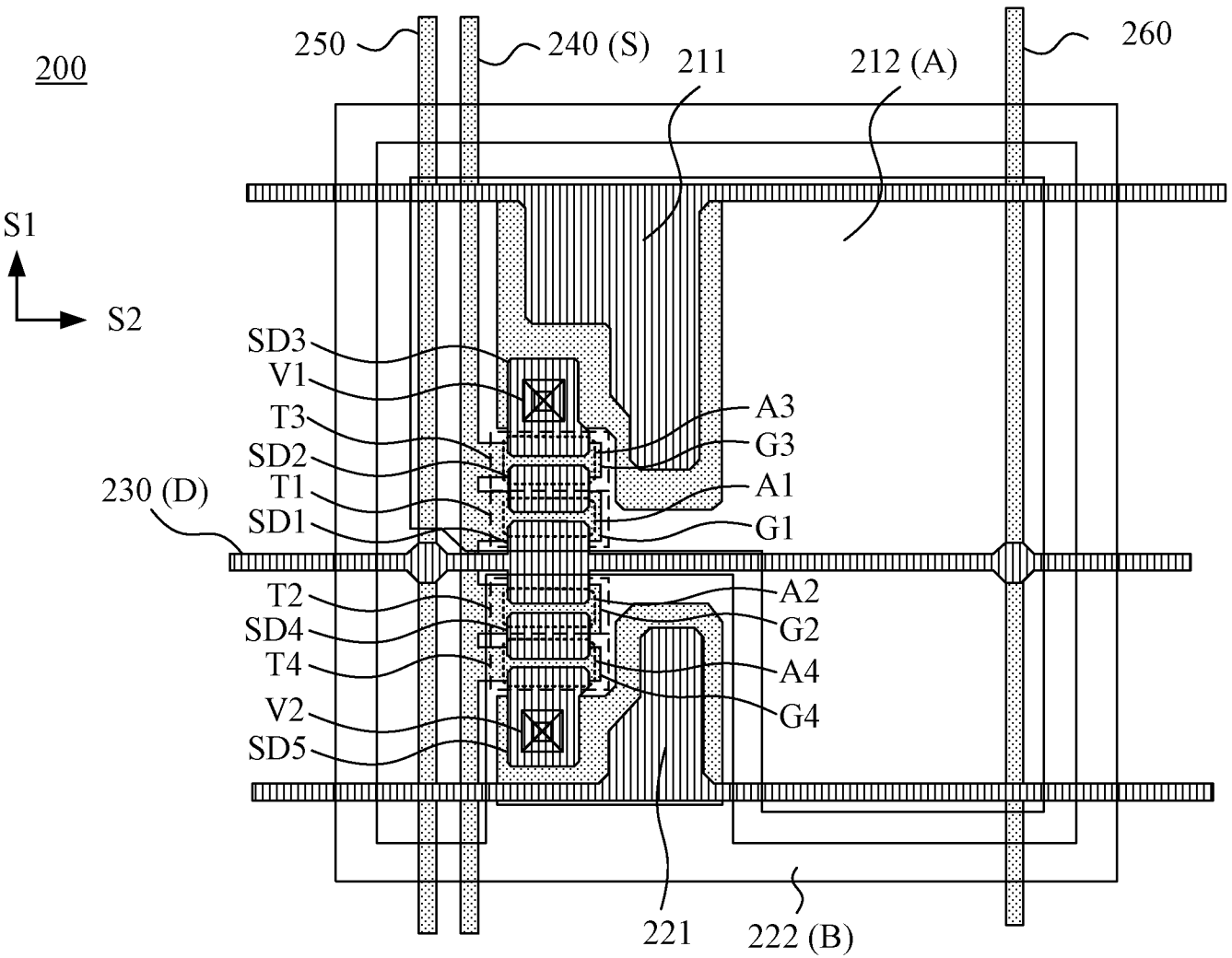
FIG. 2 is a schematic diagram of a layout of the display device in accordance with some embodiments of the present disclosure.

For illustrating the layout of the display device 100B, reference is made to FIG. 1B and FIG. 2. FIG. 2 is a schematic diagram of a layout 200 of the display device 100B in accordance with some embodiments of the present disclosure. As shown in FIG. 2, in the layout 200, the data source lines 250, 260 and the selection line 240 (i.e., the selection line S in FIG. 1B) are arranged along a first direction S1, and the data line 230 (i.e., the data line D in FIG. 1B) are arranged along a second direction S2, in which the first direction S1 is different from the second direction S2. The transistor T1 and T3 are arranged on one side of the data line 230, and the transistor T2 and T4 are arranged on the other side of the data line 230. The transistor T1 includes the source/drain areas SD1 and SD2, the active area A1 and the gate area G1; the transistor T2 includes the source/drain areas SD1 and SD4, the active area A2 and the gate area G2; the transistor T3 includes the source/drain area SD2 and SD3, the active area A3 and the gate area G3; and the transistor T4 includes the source/drain area SD4 and SD5, the active area A4 and the gate area G4. The electrode 211 and the electrode 212 (as the node A in FIG. 1B) of the subpixel SP1 form the capacitor C1; and the electrode 221 and the electrode 222 (as a node B in FIG. 1B) of the subpixel SP2 form the capacitor C2. It is noted that, as shown in FIG. 2, the electrode 222 of the subpixel SP2 is arranged around the subpixel SP1 and surrounds the subpixel SP1 to isolate the subpixel SP1 and the neighboring pixels (not shown). Therefore, the influence of neighboring pixels on the capacitor C1 of the subpixel SP1 (including the electrode 211 and 212) can be effectively reduced.

The transistor T3 is coupled to the electrode 212 through a via V1 (i.e., being coupled to the capacitor C1), and the transistor T4 is coupled to the electrode 222 through a via V2 (i.e., being coupled to the capacitor C2). Therefore, when the selection line 240 transmits an enable signal to the transistors T1-T4, the data signal of the data line 230 may be transmitted to the capacitor C1 via the transistor T1 and T3, and may be transmitted to the capacitor C2 via the transistor T2 and T4. It is noted that, the capacity of the capacitor C1 can be adjusted by changing the areas of the electrode 211 and 212, and the capacity of the capacitor C2 can be adjusted by changing the areas of the electrode 221 and 222, so as to improve the electric leakage problem of the capacitor C1 when being under a high temperature environment or under the condition that the neighboring pixels have different polarities.

In one embodiment, the data source line 250 is coupled to the data line 230, so as to provide the data signal to the data line 230. In another embodiment, the data source line 260 is coupled to the data line 230, so as to provide the data signal to the data line 230.

In practice, the data line 230, the selection line 240, the data source lines 250, 260, the electrodes 211, 212, 221 and 222, the gate areas G1-G4, the source/drain areas SD1-SD5 may be, but is not limited to, a metal layer and the active areas A1-A4 may be, but is not limited to, a semiconductor layer (i.e., an amorphous silicon layer).

Figure 3:
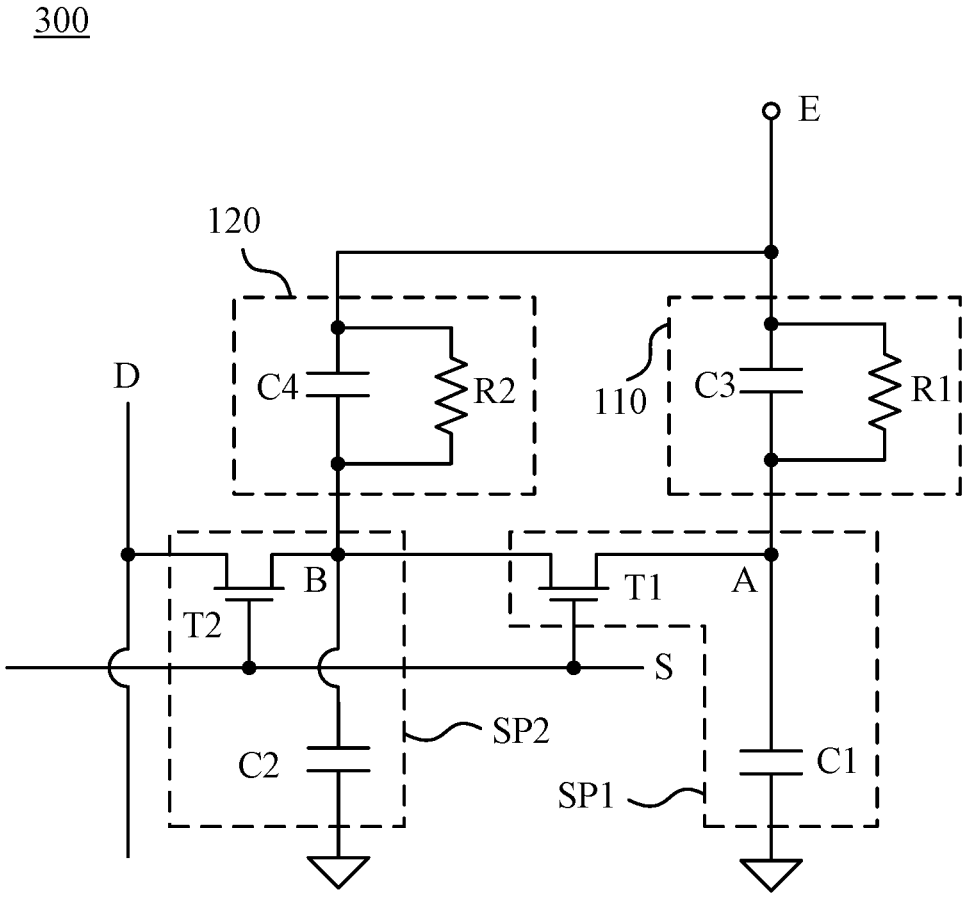
FIG. 3 is a schematic diagram of the display device in accordance with some embodiments of the present disclosure.

In another embodiment, a coupling manner between the transistors T1, T2 and the data line D may be varied. Reference is now made to FIG. 3, in which FIG. 3 is a schematic diagram of a display device 300 in accordance with some embodiments of the present disclosure. The structure of the display device 300 and the structure of the display device 100A are almost the same, besides the coupling manner between the transistors T1, T2 and the data line D. The differences between the display device 300 and the display device 100A are described below. In the display device 300, the transistor T2 is coupled between the data line D and the transistor T1. As shown in FIG. 3, the control end of the transistors T1 and T2 are coupled to the selection line S, the first end of the transistor T2 is coupled to the data line D, the second end of the transistor T2 is coupled to the first end of the transistor T1 and the capacitor C2 at the node B, and the second end of the transistor T1 is coupled to the capacitor C1 at the node A.

In operation, the transistors T1 and T2 are coupled to the same selection line S, and may be simultaneously turned on or off according to the same selection signal. When the transistors T1 and T2 are simultaneously turned on according to the selection signal, the transistor T2 transmits the data signal to the capacitor C2 and the transistor T1, and the transistor T1 transmits the data signal to the capacitor C1.

As a result, when being under a high temperature environment or under the condition that the neighboring pixels have different polarities, the subpixel SP2 surrounding the subpixel SP1 may improve the electric leakage of the capacitor C1 of the subpixel SP1, thus improving the display quality of the display device 300.

Figure 4:
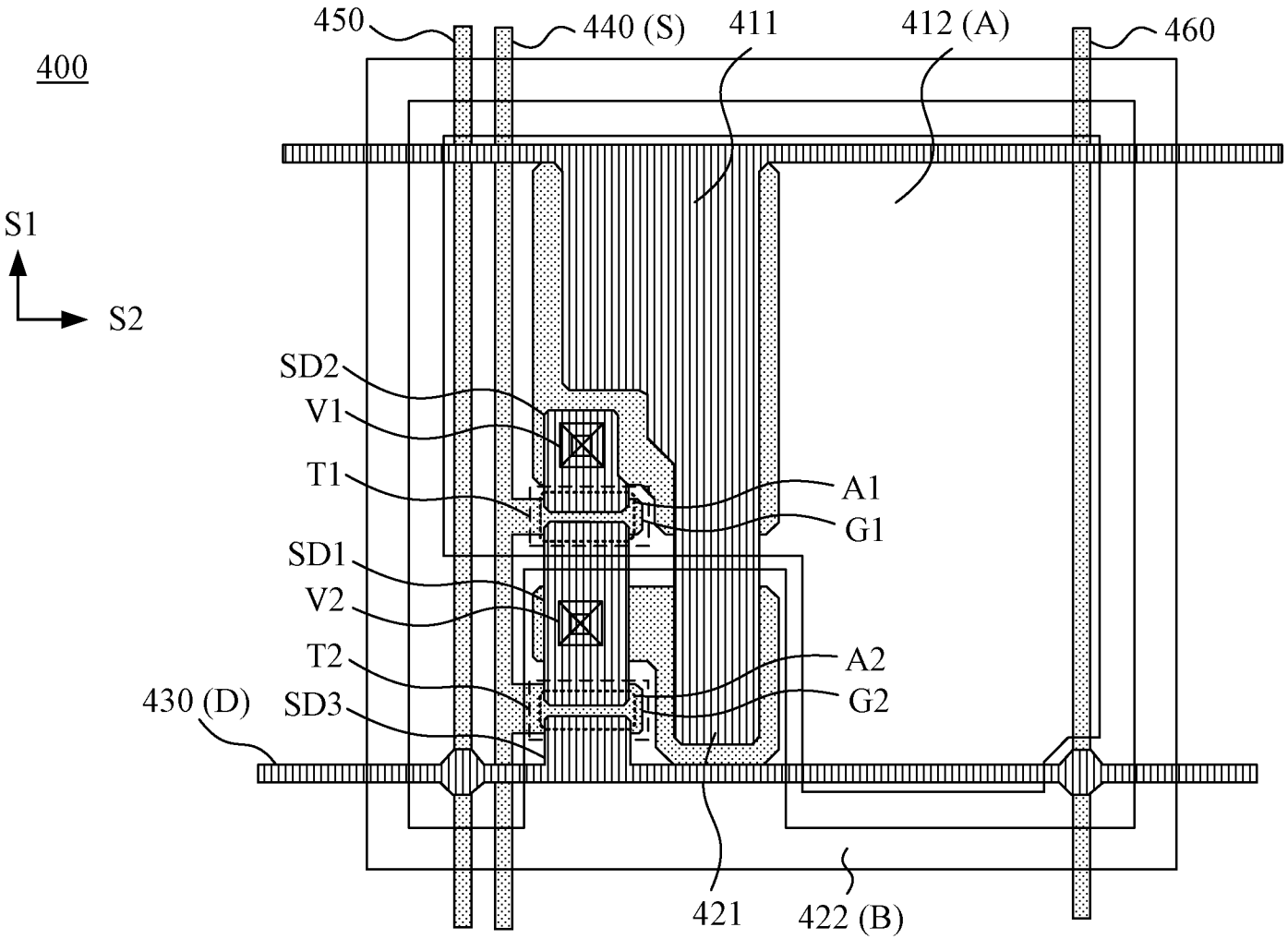
FIG. 4 is a schematic diagram of a layout of the display device in accordance with some embodiments of the present disclosure.

For illustrating of the layout of the display device 300, reference is made to FIG. 3 and FIG. 4. FIG. 4 is a schematic diagram of a layout 400 of the display device 300 in accordance with some embodiments of the present disclosure. As shown in FIG. 4, in the layout 400, the data source lines 450 and 460 and the selection line 440 (i.e., the selection line S in FIG. 3) are arranged along the first direction S1, and the data line 430 (i.e., the data line D in FIG. 3) are arranged along the second direction S2, in which the first direction S1 is different from the second direction S2. The transistor T1 includes the source/drain areas SD1, SD2, the active area A1 and the gate area G1, and the transistor T2 includes the source/drain areas SD1 and SD4, the active area A2 and the gate area G2. The electrode 411 and the electrode 412 (as the node A in FIG. 3) of the subpixel SP1 form the capacitor C1, and the electrode 421 and the electrode 422 (as the node B in FIG. 3) of the subpixel SP2 form the capacitor C2. It is noted that, as shown in FIG. 4, the electrode 422 of the subpixel SP2 is arranged around the subpixel SP1 and surrounds the subpixel SP1, so as to isolate the subpixel SP1 from the neighboring pixels (not shown).

The transistor T1 is coupled to the electrode 412 through a via V1 (i.e., being coupled to the capacitor C1), and the transistor T2 is coupled to the electrode 422 through a via V2 (i.e., being coupled to the capacitor C2). Therefore, when the selection line 440 transmits an enable signal to the transistors T1 and T2, the data signal of the data line 430 may be transmitted to the capacitor C2 via the transistor T2, and may be transmitted to the capacitor C1 via the transistor T1 and T2. It is noted that, the capacity of the capacitor C1 may be adjusted by changing the areas of the electrode 411 and 412, and the capacity of the capacitor C2 can be adjusted by changing the areas of the electrode 421 and 422, so as to improve the leakage problem of the capacitor C1 when being under a high temperature environment or under the condition that the neighboring pixels have different polarities.

In one embodiment, the data source line 450 is coupled to the data line 430, so as to provide the data signal to the data line 430. In another embodiment, the data source line 460 is coupled to the data line 430, so as to provide the data signal to the data line 430.

In practice, the data line 430, the selection line 440, the data source lines 450 and 460, the electrodes 411, 412, 421 and 422, the gate areas G1-G4, and the source/drain areas SD1-SD5 may be, but is not limited to, a metal layer, and the active areas A1-A4 may be, but is not limited to, a semiconductor layer (i.e., an amorphous silicon layer).

In summary, when being under a high temperature environment or under the condition that the neighboring pixels have different polarities, the subpixel SP2 surrounding the subpixel SP1 may improve the electric leakage of the capacitor C1 of the subpixel SP1, thus improving the display quality of the display devices 100A, 100B and 300. In addition, the amount of the transistors of the subpixel units SP1 and SP2 can be increased to reduce the leakage current of the capacitors C1 and C2, thus improving the display quality of the display devices 100B.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A display device, comprising:

a selection line configured to provide a selection signal;

a data line configured to provide a data signal; and a plurality of pixel units, wherein each of the pixel unit comprises:

a first subpixel comprising a first capacitor; and a second subpixel disposed around the first subpixel and surrounding the first subpixel, wherein the second subpixel comprises a second capacitor, the first subpixel is configured to transmit the data signal to the first capacitor according to the selection signal, and the second subpixel is configured to transmit the data signal to the second capacitor according to the selection signal;

wherein the first subpixel further comprises:

a first transistor coupled to the selection line and the first capacitor, and configured to transmit the data signal to the first capacitor according to the selection signal; and the second subpixel further comprises:

a second transistor coupled to the selection line, the data line, the second capacitor and the first transistor, and configured to transmit the data signal to the second capacitor according to the selection signal, and to transmit the data signal to the first transistor according to the selection signal to transmit the data signal to the first capacitor.

2. The display device of claim 1, wherein the first subpixel further comprises:

a second transistor coupled to the selection line and the data line, and configured to transmit the data signal to the first capacitor according to the selection signal; and the second subpixel further comprises:

a third transistor coupled to the selection line and the data line, and configured to transmit the data signal to the second capacitor according to the selection signal.

3. The display device of claim 2, wherein the second transistor and the third transistor are arranged on two sides of the data line respectively.

4. The display device of claim 2, wherein the first subpixel further comprises:

a fourth transistor coupled to the selection line, the second transistor and the first capacitor, and configured to receive the data signal transmitted from the second transistor according to the selection signal and to transmit the data signal to the first capacitor; and the second subpixel further comprises:

a fifth transistor coupled to the selection line, the third transistor and the second capacitor, and configured to receive the data signal transmitted from the third transistor according to the selection signal and to transmit the data signal to the second capacitor.

5. The display device of claim 4, wherein the fourth transistor and the fifth transistor are arranged on two sides of the data line respectively.

6. The display device of claim 2, wherein the second transistor and the third transistor are simultaneously turned on or off according to the selection signal.

7. The display device of claim 1, wherein the first transistor and the second transistor are simultaneously turned on or off according to the selection signal.

8. The display device of claim 1, further comprising:

a data source line coupled to the data line and configured to provide the data signal to the data line.

9. The display device of claim 8, wherein the selection line and the data source line are arranged along a first direction, the data line are arranged along a second direction that is different from the first direction.

10. The display device of claim 1, wherein the second subpixel includes an electrode surrounding the first subpixel.

* * * * *